US009969066B2

(12) United States Patent
Li

(10) Patent No.: US 9,969,066 B2
(45) Date of Patent: May 15, 2018

(54) RATCHET SCREWDRIVER

(71) Applicant: Yongguang Li, Ningbo (CN)

(72) Inventor: Yongguang Li, Ningbo (CN)

( * ) Notice: Subject to any disclaimer, the term of this patent is extended or adjusted under 35 U.S.C. 154(b) by 763 days.

(21) Appl. No.: 14/258,721

(22) Filed: Apr. 22, 2014

(65) Prior Publication Data

US 2015/0107422 A1 Apr. 23, 2015

(30) Foreign Application Priority Data

Oct. 17, 2013 (CN) ..... 2013 2 0642437 U

(51) Int. Cl.
*B25B 13/46* (2006.01)
*B25B 15/04* (2006.01)

(52) U.S. Cl.
CPC ..... *B25B 15/04* (2013.01); *B25B 13/465* (2013.01); *B25B 13/46* (2013.01); *B25B 13/461* (2013.01); *B25B 13/462* (2013.01); *B25B 13/468* (2013.01)

(58) Field of Classification Search
CPC ..... B25B 15/04; B25B 13/465; B25B 13/46; B25B 13/461; B25B 13/462; B25B 13/468
See application file for complete search history.

(56) References Cited

U.S. PATENT DOCUMENTS 2,407,558 A * 9/1946 Kress ..... B25B 13/465 192/43.1
5,687,820 A * 11/1997 Lin ..... B25B 13/463 192/43.2
6,047,617 A * 4/2000 Chen ..... B25B 15/04 81/58.4
6,622,597 B2 * 9/2003 Chen ..... B25B 13/466 81/438
6,854,363 B2 * 2/2005 Ping ..... B25B 15/04 192/43.2
7,237,459 B1 * 7/2007 Shiao ..... B25B 13/465 81/62
7,287,448 B2 * 10/2007 Hu ..... B25B 15/04 81/58.4
7,677,137 B1 * 3/2010 Chen ..... B25B 13/465 81/62
7,926,391 B2 * 4/2011 Hu ..... B25B 13/465 81/436
2009/0217789 A1 * 9/2009 Chang ..... B25B 13/465 81/60
2012/0048068 A1 * 3/2012 Xu ..... B25B 15/04 81/62
2012/0055290 A1 * 3/2012 Chen ..... B25B 15/04 81/63.1

* cited by examiner

*Primary Examiner* — Bryan R Muller
(74) *Attorney, Agent, or Firm* — Wang Law Firm, Inc.

(57) ABSTRACT

A ratchet screwdriver includes a ratchet wheel; a pawl base assembly, for inserting into the ratchet wheel, and a plurality of pawl pieces for engaging with teeth, the rear end of the pawl base assembly connecting to a handle of a screwdriver while the front end connecting to a head of the screwdriver; a rings assembly adjustably mounted on the ratchet wheel; the pawl base assembly includes a center rod and a pedestal, the rear part of the center rod is provided with a first positioning slot, the center rod passes through the center hole of the pedestal, the center rod is clamped at the first positioning slot by a first clamping member. Compared with the prior art, the overall structure is more rational and practical, and is safer and more reliable in use, and is capable of loosening or tighten a screw quickly.

12 Claims, 5 Drawing Sheets

RATCHET SCREWDRIVER

RELATE APPLICATIONS

This application claims the benefit of Chinese Utility Model Application 201320642437.6, filed on Oct. 17, 2013, the specification of which is incorporated herein by this reference.

FIELD OF THE INVENTION

The present invention relates to a screwdriver and particularly to a ratchet screwdriver.

DESCRIPTION OF THE PRIOR ART

As one of the common hardware tools, screwdrivers are used for loosening or tightening screws. A common screwdriver generally includes a handle, a toolbar and a head. Users rotate the handle of the screwdriver to drive the toolbar and the head of the screwdriver to rotate, so that the head drives a screw to rotate in order to loosen or tighten the screw. A common screwdriver rotates totally depending on manpower, so it is strenuous to use the screwdriver and difficult to control its direction. It is likely to cause convolution during the rotation, so that the use efficiency is relatively low. Therefore, some ratchet screwdrivers capable of realizing one-way idling are designed, for example, a Chinese Patent CN2307658Y (Patent No.: ZL 97235059.4), titled "Hidden Ratchet Screwdriver" and a Chinese Patent CN2900088Y (Patent No.: ZL200620103975.8), titled "Combined Ratchet Screwdriver". The Chinese Patent CN2307658Y discloses that the ratchet screwdriver comprises a spring, an extension rod, a transmission rod, a ratchet set consisting of a positioning ratchet, a leftward ratchet and a rightward ratchet, a positioning lug and other components. The Chinese Patent CN2900088Y discloses that the ratchet screwdriver comprises a connecting base, a ring, a brake block, an arc sliding sleeve and other structures. Although both the two ratchet screwdrivers can realize the one-way rotation of the ratchet screwdriver, they are complicated in structure, large in size and relatively complicated in assembling and manufacturing. Furthermore, it is likely to result in the failure of the screwdrivers due to the damage or missing of a small component.

In practical applications, ratchet screwdrivers also have the following disadvantages: on one hand, due to the positioning of a pawl base and a ratchet, the rotation of a ratchet screwdriver is realized by hexagonal connection, so the torsion can not meet the requirements in use, which is likely to result in slipping; on the other hand, during the installation of the toothed plates, the rectangular plates are directly fitted with rectangular grooves on the pawl base, in this case, although the normal functions of the ratchet may be realized, such assembly goes against good positioning and the toothed plates are easy to slip off, as a result, the installation is inconvenient and the accurate fitting between the toothed plates and the external teeth is thus influenced.

SUMMARY OF THE INVENTION

It is an object of the present invention to provide a ratchet screwdriver having improved torsion and safer and more reliable use.

For achieving this object, the ratchet screwdriver, comprises: a ratchet wheel having an inner surface with a tooth ring; a pawl base assembly, for inserting into the ratchet wheel, having a front end, a rear end, and a plurality of pawl pieces for engaging with teeth on the tooth ring, the rear end of the pawl base assembly connecting to a handle of a screwdriver while the front end connecting to a head of the screwdriver; and a rings assembly adjustably mounted on the ratchet wheel; wherein the pawl base assembly includes a center rod with a front end, a middle section, and a rear part and a pedestal with a center hole and a rear end, the rear part of the center rod passes through the center hole of the pedestal, the middle section has a circular periphery, the pedestal has a circular periphery, the circular periphery of the middle section of the center rod is provided with a plurality of protrusions, and the inner surface at a front end of the ratchet wheel is provided with a plurality of limiting recesses for receiving the plurality of protrusions, the rear end of the pedestal connects to the handle of the screwdriver, and the head of the screwdriver inserts into the front end of the center rod, a first groove, a second groove, a third groove and a fourth groove are provided on the circular periphery of the pedestal, four grooves each along the axis of the center rod, and a first pawl piece, a second pawl piece, a third pawl piece and a fourth pawl piece are respectively rotatably inserted into each of the four grooves, each pawl piece has a tooth-shape outer end for engaging with the teeth of the tooth ring, two elastic elements are respectively resisted between the first pawl piece and the fourth pawl piece, and between the second pawl piece and the third pawl piece, for pushing the first pawl piece away from the fourth pawl piece, and pushing the second pawl piece away from the third pawl piece, and the rings assembly is provided therein with a plurality of push portions for engaging the pawl pieces and selectively disconnecting the pawl pieces from the teeth of the tooth ring to rotate the pawl base assembly.

Preferably, the rear part of the center rod is provided with a first positioning slot, the center rod is clamped at the first positioning slot by a first clamping member to limit displacement of the pedestal.

Preferably, there are four protrusions distributed on the circular periphery of the center rod, correspondingly, and there are also four limiting recesses on the front end of the ratchet wheel Preferably, the end of each groove is an arc groove with a C-shape, inner ends of the pawl pieces have arc surfaces, and the inner ends of the pawl pieces are rotatably disposed in the arc grooves.

In the existing ratchet screwdrivers, matching of the rectangular pawl pieces and the rectangular grooves of the pedestal results in poor positioning effect. As a result, the pawl pieces are easy to slip off from the grooves and the installation is inconvenient, so that accurate matching between the pawl pieces and an external tooth ring is influenced. In the present invention, the rear ends of the pawl pieces are cylinders having a lager diameter than that of the front ends of the pawl pieces, and the pedestal is provided thereon with cylindrical grooves correspondingly, so that the matching of cylinders and grooves makes the pawl pieces slip off hardly. The axes of the rear ends of the pawl pieces rotate around the axes of the grooves of the pedestal, so the better matching precision of the pawl pieces and the tooth ring are ensured, and the stability and safety in use of the product can be greatly improved.

Preferably, the rings assembly includes a ring and a release ring with an inner surface and an outer surface, the release ring is disposed inside the ring, the ring drives the release ring to rotate, the ratchet wheel is located between the release ring and the ring, four push portions are provided on the inner surface of the release ring, recesses for receiving the push portions are provided on an outer surface of the pedestal at corresponding positions to the grooves.

Preferably, a side, in contact with the pawl pieces, of each push portion has a beveled edge with a gradient matched with a gradient of side walls of the pawl pieces, and side edges of the push portions are designed to be beveled edges matched with the pawl pieces, a force exerted by the push portions onto the pawl pieces is dispersed uniformly.

Preferably, the front part of the center rod is reduced to form an insertion portion, with a front circumference, on which a first spring is sheathed, that the first spring pushing against an connecting portion, the front circumference of the insertion portion is provided with a second positioning slot in which a second clamping member is clamped to limit displacement of the connecting portion, in a position where the center rod gets close to the second positioning slot, a first hole is provided behind the second positioning slot, a first steel ball, embedded in the center rod, protrudes from the first hole and presses against an inward-convex conical surface of a front segment of the connecting portion.

Preferably, the outer surface of the release ring is provided with a clamping bulge, and correspondingly, an inner surface of the ring is provided with a clamping slot, matching of the clamping bulge and the clamping slot enables the ring to drive the release ring to rotate.

Preferably, any two adjacent grooves among the four grooves are symmetrical relative to a center line of the pedestal, and any two spaced-apart grooves are symmetrical relative to a center axis of the pedestal.

Preferably, outside of a middle part of the pedestal is provided with a bulge ring for engaging the ring, a side of the bulge ring is provided with a second blind hole with a second spring and a second steel ball placed on top of the second spring, the second spring pushes the second steel ball, the second steel ball, embedded in the pedestal, protrudes from the second blind hole and pushes against the inner surface of the ring release, a left positioning hole, a middle positioning hole and a right positioning hole matching the second steel ball are provided on the inner surface of the release ring, when the second steel ball is located in the middle positioning hole, the pawl pieces are just all meshed, and the pawl base assembly does not rotate, when the ring drives the release ring to rotate and the second steel ball is located in the left or right positioning hole, the pawl base assembly performs one-way rotation.

Preferably, the elastic elements are double-ring torsion springs, which have higher elasticity than straight springs, so the pawl pieces can rebound or retract to the corresponding positions completely, resulting in reliable performance when in use. The double-ring torsion springs are more applicable to the above technical solution to effectively improve the assembling efficiency.

Preferably, the connecting portion is a sleeve made of iron, an outer surface of the connecting portion is distributed with concave and convex grid texture. In the present invention, taking iron instead of conventional aluminum that the cost is reduced and the intensity and service life of the connecting portion are enhanced under the premise of rust resistance.

Preferably, the center rod is a hollow rod made of zinc alloy. Under the premise of ensuring the intensity, one-step molding reduces the machining procedures, improves the precision of a single product and the production efficiency of the whole product, and thus reduces the cost.

Compared with the prior art, in the present invention, the positioning of the tooth ring on the center rod is achieved by the protrusions of the center rod, so that the torsion and torque are strengthened substantially, and the use safety of the ratchet screwdriver is better ensured; the cross-sections of the bottom of the grooves are arc grooves with a C-shape, and inner ends of the pawl pieces have arc surfaces correspondingly, so that the pawl pieces may be prevented from slipping off from the arc grooves, and the matching precision of the pawl pieces and the teeth are further ensured; finally, the rear end of the center rod is provided with a positioning slot, and the rear end of the center rod is provided with a ring after passing through a center hole of the pedestal, so that the longitudinal motion of the center rod is fixed without influencing its rotation. Therefore, the overall structure is more rational and practical, and is safer and more reliable in use.

DETAILED DESCRIPTION OF THE PREFERRED EMBODIMENT

To enable a further understanding of the innovative and technological content of the invention herein, refer to the detailed description of the invention and the accompanying drawings below:

As shown in FIG. 1 to FIG. 4, in this embodiment, a ratchet screwdriver, comprises: a ratchet wheel 100 having an inner surface with a tooth ring 5; a pawl base assembly 200, for inserting into the ratchet wheel 100, having a front end, a rear end, and a plurality of pawl pieces for engaging with teeth on the tooth ring 5, the rear end of the pawl base assembly 200 connecting to a handle of a screwdriver while the front end connecting to a head of the screwdriver; and a rings assembly 300 adjustably mounted on the ratchet wheel 100.

Figure 5:
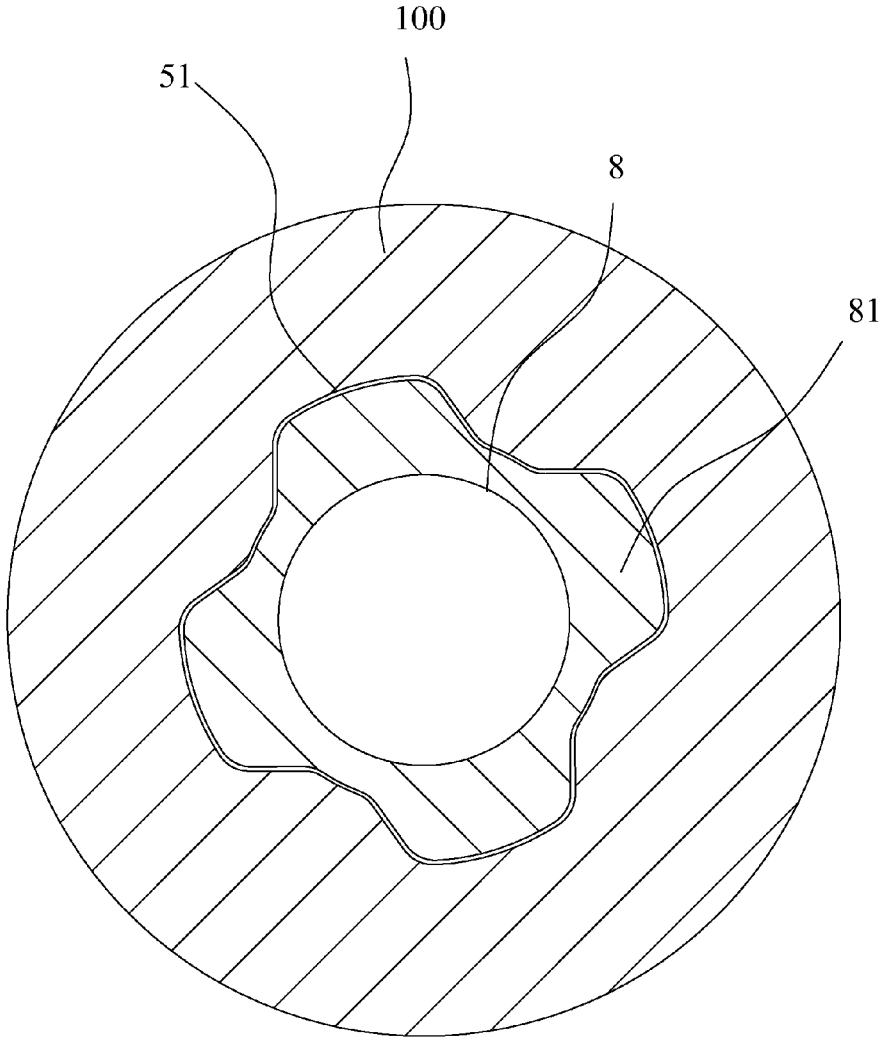
FIG. 5 is a sectional view of the crisscross protrusions disposed on the front end face of the ratchet wheel in accordance with the embodiment of the present invention.

In this embodiment, the pawl base assembly 200 includes a center rod 8 with a front end, a middle section, and a rear part and a pedestal 13 with a center hole and a rear end, the rear end of the pedestal 13 connects to the handle of the screwdriver, and the head of the screwdriver inserts into the front end of the center rod 8; the center rod 8 is a hollow rod made of zinc alloy, so that, under the premise of ensuring the intensity, one-step molding reduces the machining procedures, improves the precision of a single product and the production efficiency of the whole product, and thus reduces the cost. The rear part of the center rod 8 is provided with a first positioning slot 83, the center rod 8 passes through the center hole of the pedestal 13, and the center rod 8 is clamped at the first positioning slot 83 by a first clamping member 14 to limit displacement of the pedestal 13. There are four protrusions 81 distributed on the circular periphery of the center rod 8, correspondingly, and there are also four limiting recesses 51 on the front end of the ratchet wheel 100, as shown in FIG. 5, so that the center rod 8 can be rotated together with the ratchet wheel 100.

The front part of the center rod 8 is reduced to form an insertion portion 84, with a front circumference, on which a first spring 3 is sheathed, the inner end of the first spring 3 presses against the inner annular surface of the insertion portion 84 and annular surface of the insertion portion 84 is pressed against the inward-convex ring of the connecting portion 1, for pushing the connecting portion 1 away from the insertion portion 84, the front circumference of the insertion portion 84 is provided with a second positioning slot 82 in which a second clamping member 2 is clamped to limit displacement of the connecting portion 1 matching with the inner annular surface of the insertion portion 84, in a position where the center rod 8 gets close to the second positioning slot 82, a first hole 85 is provided behind the second positioning slot 82, a first steel ball 7, embedded in the center rod, protrudes from the first hole 85 and presses against an inward-convex conical surface 1*a* of a front segment of the connecting portion 1. The connecting portion 1 is a sleeve made of iron, an outer surface of the connecting portion 1 is distributed with concave and convex grid texture, in this embodiment, taking iron instead of conventional aluminum that the cost is reduced and the intensity and service life of the connecting portion are enhanced under the premise of rust resistance. The connecting portion 1, the first spring 3 and the first steel ball 7 and etc form a quick locking mechanism for quickly locking the head of the screwdriver inserted into the front end of the center rod 8. When the connecting portion 1 is pushed backward, the first steel ball 7 may protrude to be movable. In this way, the head of the screwdriver may be conveniently inserted into the front end of the center rod 8. Then, the connecting portion 1 moves forward under the push of the first spring 3, and the first steel ball 7 is pressed by the inward-convex conical surface 1*a* of the front segment of the connecting portion 1, so that the head of the screwdriver is locked again.

The rear end of the pedestal 13 of the pawl base assembly 200 connects to the handle of the screwdriver. a first groove 95, a second groove 96, a third groove 97 and a fourth groove 98 are provided on the circular periphery of the pedestal 13, four grooves each along the axis of the center rod 8, any two adjacent grooves among the four grooves are symmetrical relative to a center line of the pedestal 13, and any two spaced-apart grooves are symmetrical relative to a center axis of the pedestal 13; and a first pawl piece 91, a second pawl piece 92, a third pawl piece 93 and a fourth pawl piece 94 are respectively rotatably inserted into each of the four grooves, each pawl piece has a tooth-shape outer end for engaging with the teeth of the tooth ring 5, two elastic elements 10 are respectively resisted between the first pawl piece 91 and the fourth pawl piece 94, and between the second pawl piece 92 and the third pawl piece 93, in the embodiment, the elastic elements 10 are double-ring torsion springs, which push the first pawl piece 91 away from the fourth pawl piece 94, and push the second pawl piece 92 away from the third pawl piece 93. To prevent the pawl pieces from slipping off from the grooves, the degree of opening of the four grooves increases gradually, the end of each groove is an arc groove with a C-shape, inner ends of the pawl pieces have arc surfaces, and the inner ends of the pawl pieces are rotatably disposed in the arc grooves. Outside of a middle part of the pedestal 13 is provided with a bulge ring 15 for engaging the ring 4, a side of the bulge ring 15 is provided with a second blind hole 16 with a second spring 11 and a second steel ball 12 placed on top of the second spring 11, the second spring 11 pushes the second steel ball, the second steel ball 12, embedded in the pedestal, protrudes from the second blind hole 16 and pushes against the inner surface of the release ring 6, a plurality of positioning holes 63 matching the second steel ball 12 are provided on the inner surface of the release ring 6.

In this embodiment, there are left, middle and right positioning holes 63. when the second steel ball 12 is located in the middle positioning hole 63, the pawl pieces are just all meshed, and the pawl base assembly 200 does not rotate, when the ring 4 drives the release ring 6 to rotate and the second steel ball 12 is located in the left or right positioning hole 63, the pawl base assembly 200 performs one-way rotation.

In this embodiment, the rings assembly 300 includes a ring 4 and a release ring 6 with an inner surface and an outer surface, the release ring 6 is disposed inside the ring 4, the outer surface of the release ring 6 is provided with a clamping bulge 61, and correspondingly, an inner surface of the ring 4 is provided with a clamping slot 41, matching of the clamping bulge 61 and the clamping slot 41 enables the ring 4 to drive the release ring 6 to rotate, the ratchet wheel 100 is located between the release ring 6 and the ring 4, the inner surface of the release ring 6 is provided with a plurality of push portions 62 for engaging the pawl pieces and selectively disconnecting the pawl pieces from the teeth of the tooth ring 5 to rotate the pawl base assembly 200, there are four push portions 62, each engages a pawl piece, arc recesses 131 for receiving the push portions 62 are provided on an outer surface of the pedestal 13 at corresponding positions to the grooves, and inner ends of the push portions 62 also have arc surfaces relative to arc recesses 131. The release ring 6 passes through the rear end of the pedestal 13 to be sheathed on the pedestal 13, the push portions 62 of the inner surface of the release ring 6 respectively inserts into the corresponding recesses for engaging the outer ends of the pawl pieces, when the ring 4 drives the release ring 6 to rotate, the pawl pieces is driven to engage and disconnect the teeth of the tooth ring 5, then the pawl base assembly 200 performs one-way rotation relative to the ring 4.

Figure 1:
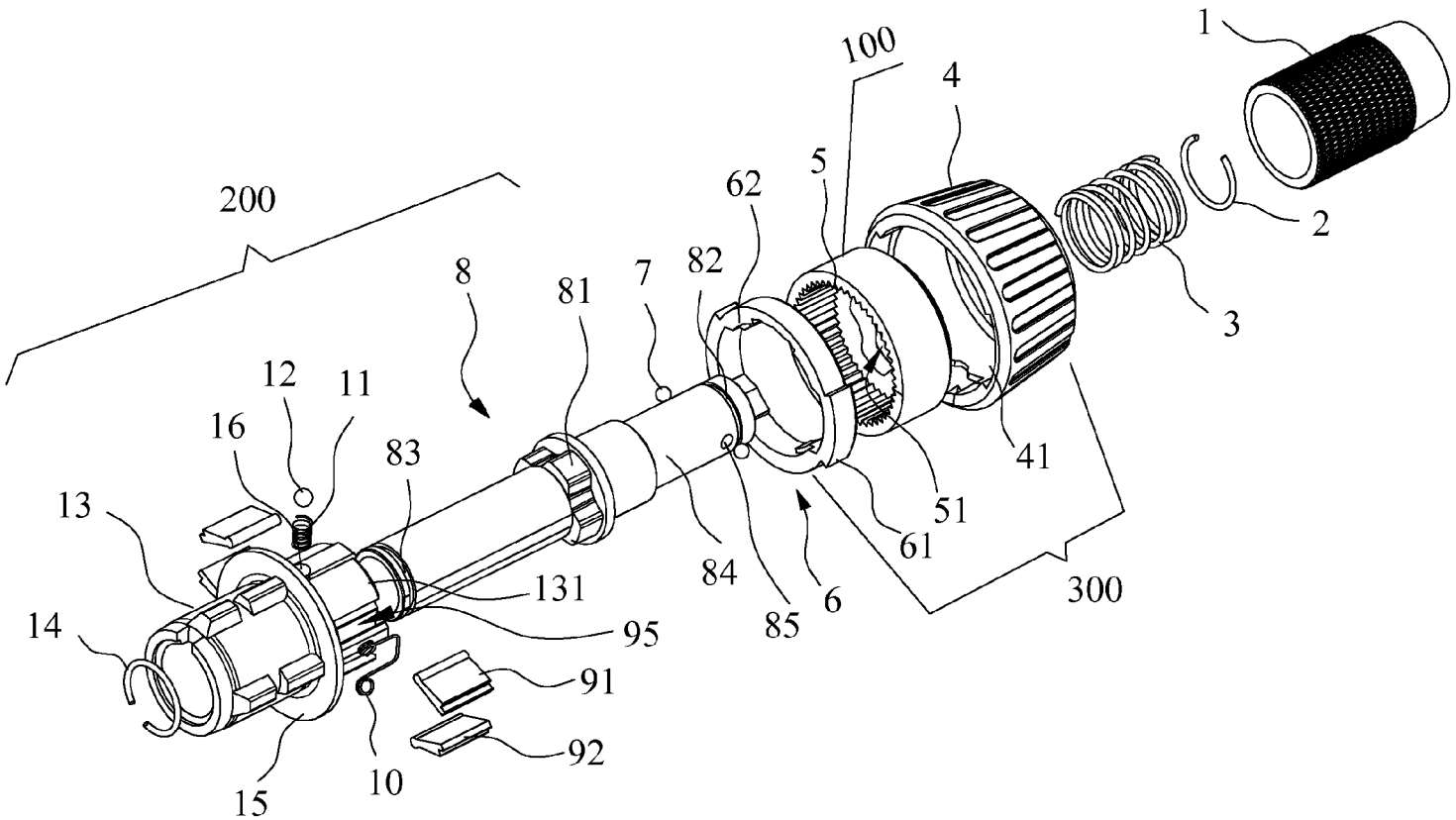
FIG. 1 is an exploded perspective view of a ratchet screwdriver in accordance with an embodiment of the present invention.
Figure 2:
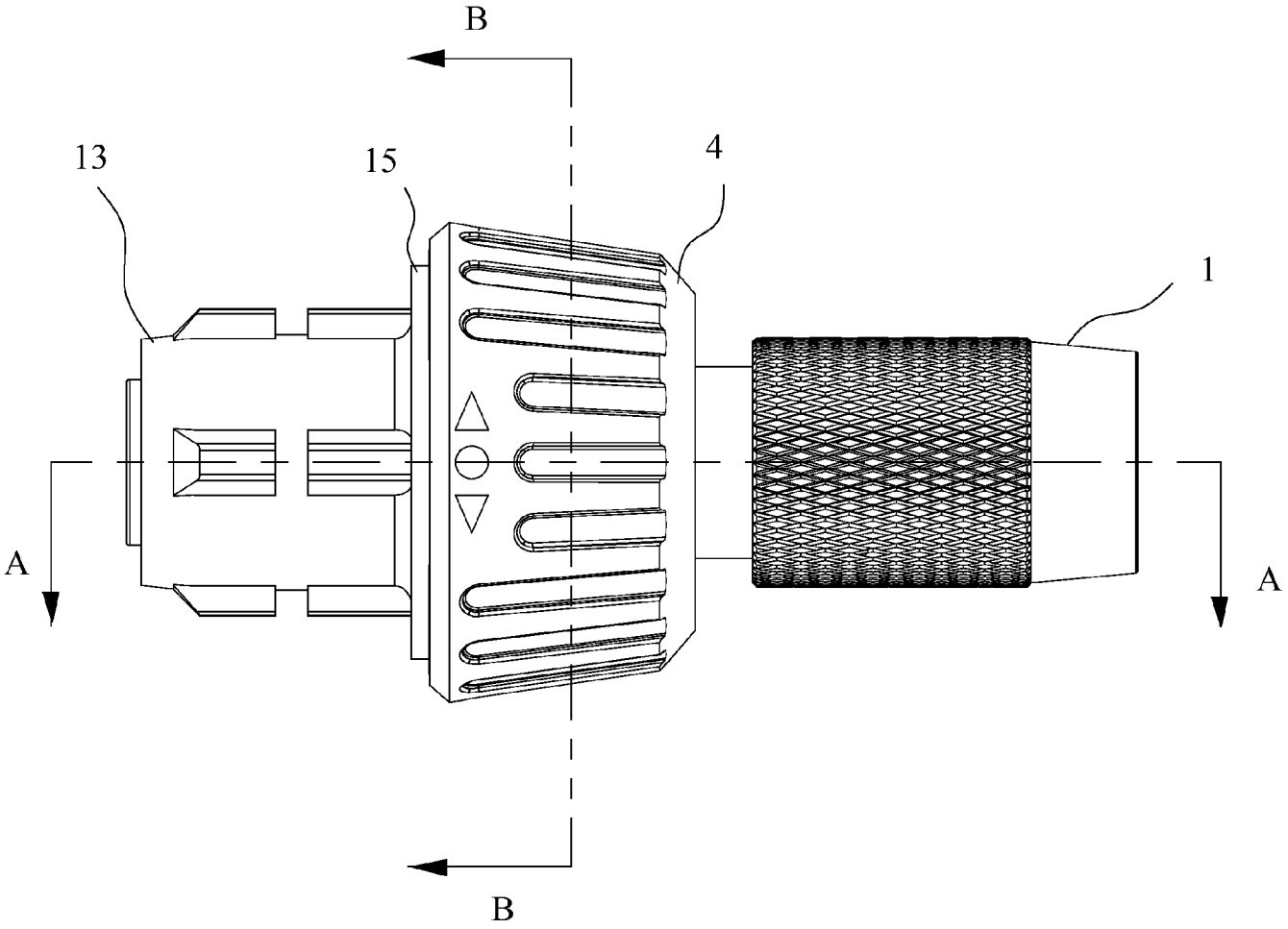
FIG. 2 is a partial view of the ratchet screwdriver in accordance with the embodiment of the present invention.
Figure 3:
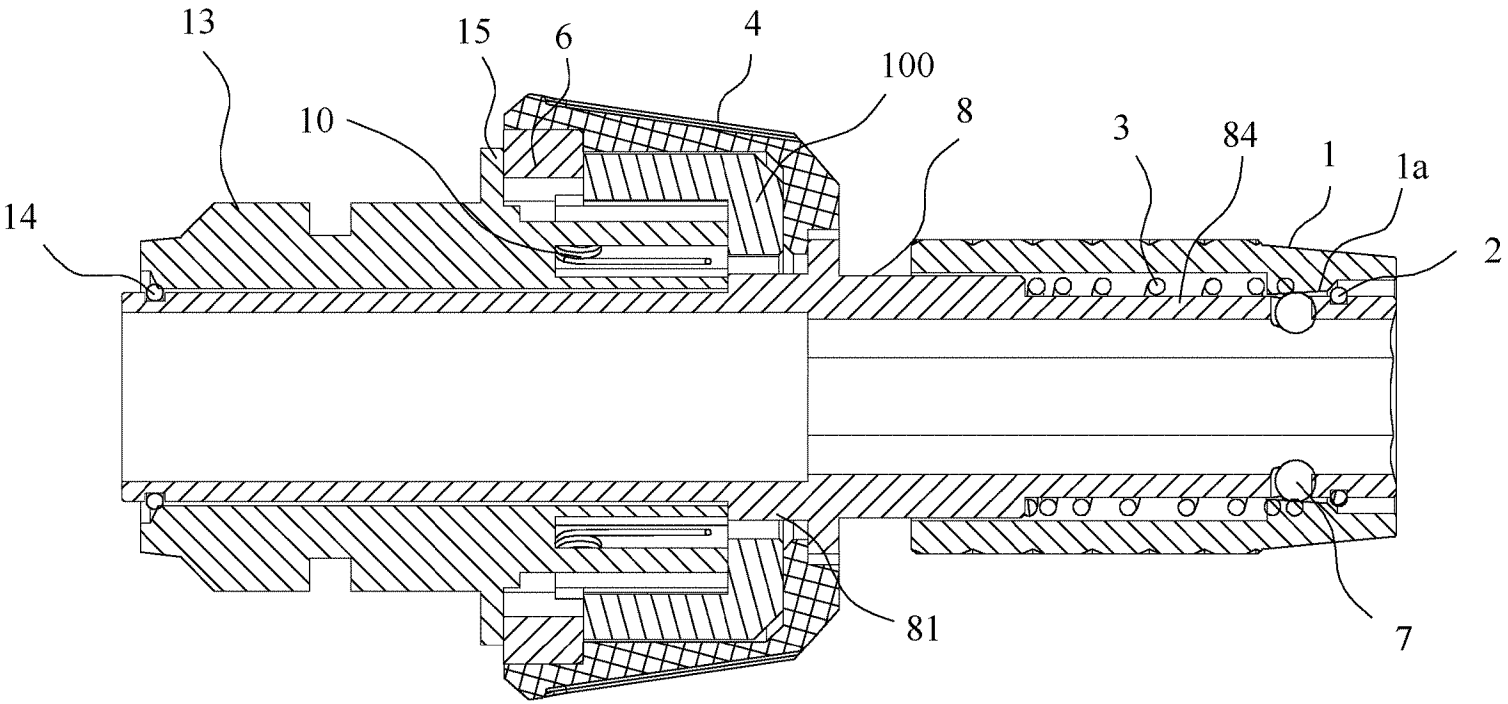
FIG. 3 is a sectional view of line A-A of FIG. 2.
Figure 4:
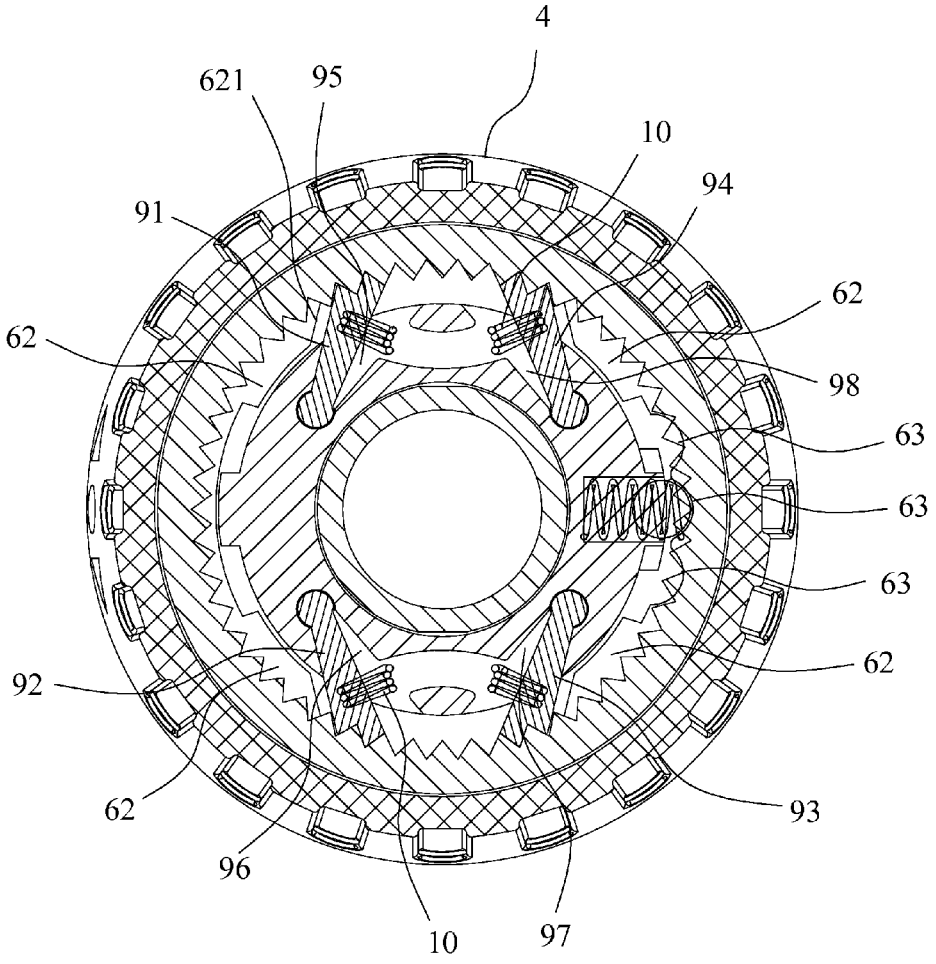
FIG. 4 is a sectional view of line B-B of FIG. 2.

This embodiment employs a universal external member, i.e., the ring 4, which is a ratchet structure rotating while the pawl pieces are inserted into or pushed away from the tooth grooves by a predetermined rotation. Referring to FIG. 4, when the second steel ball 12 is located in the middle positioning hole 63, the four pawl pieces are just all meshed under the action of the elastic members 10, and the pawl base assembly 200 does not rotate. In this case, when the handle of the screwdriver is rotated clockwise, the handle drives the pedestal 13 to rotate clockwise. The pedestal 13 drives the ratchet 100 to rotate clockwise as the pawl pieces are engaged with the teeth of the tooth ring 5, and the ratchet 100 drives the center rod 8 to rotate clockwise under the action of the limiting recesses 51. Finally, the center rod 8 drives the head of the screwdriver to rotate clockwise. At this time, the head of the screwdriver is in a clockwise operating state. If the handle of the screwdriver is rotated anticlockwise, the head of the screwdriver is in an anticlockwise operating state. When the ring 4 is rotated anticlockwise under the action of an external force and the second steel ball 12 is located in the right positioning hole 63, the push portions 62 push the fourth pawl piece 94 and the second pawl piece 92 to generate deflection against the elasticity of the elastic elements 10, so that the fourth pawl piece 94 and the second pawl piece 92 are disconnected from the teeth while the first pawl piece 91 and the third pawl piece 93 are engaged with the teeth of the tooth ring 5. Therefore, the pawl base assembly 200 can perform one-way anticlockwise rotation to rotate by a certain angle, while the ratchet 100 may rotate clockwise relative to the ring 4. Meanwhile, the ratchet 100 may drive the center rod 8 to rotate clockwise, and the center rod 8 drives the head of the screwdriver to rotate clockwise. At this time, if the handle of the screwdriver is rotated clockwise, the handle drives the pedestal 13 to rotate clockwise. As the pawl pieces are engaged with the teeth, the ratchet 100 drives the center rod 8 to rotate clockwise simultaneously; as a result, the clockwise working force of the head of the screwdriver is further strengthened. When the ring 4 is rotated clockwise and the second steel ball 12 is located in the left positioning hole 63, the push portions 62 push the first pawl piece 91 and the third pawl piece 93 to generate deflection against the elasticity of the elastic elements 10, so that the first pawl piece 91 and the third pawl piece 93 are disconnected from the teeth while the fourth pawl piece 94 and the second pawl piece 92 are engaged with the teeth. Therefore, the pawl base assembly 200 can perform one-way clockwise rotation to rotate by a certain angle, while the ratchet 100 may rotate anticlockwise relative to the ring 4. Meanwhile, the ratchet 100 may drive the center rod 8 to rotate anticlockwise, and the center rod 8 drives the head of the screwdriver to rotate anticlockwise. At this time, if the handle of the screwdriver is rotated anticlockwise, the handle drives the pedestal 13 to rotate anticlockwise. As the pawl pieces are engaged with the teeth, the ratchet 100 drives the center rod 8 to rotate anticlockwise simultaneously; as a result, the anticlockwise working force of the screwdriver bit is further strengthened.

The working principle of the ratchet screwdriver in this embodiment is as follows: when the ring 4 rotates in a certain direction, the pawl pieces are engaged with or disconnected from the teeth under the external force of the push portions 62, and the pawl base assembly 200 rotates towards the same direction; and when the ring 4 does not rotate, the pawl pieces are all engaged with the teeth, and the pawl base assembly 200 cannot rotate and stays in an idle state.

The invention claimed is:

1. A ratchet screwdriver, comprising:

a ratchet wheel having an inner surface with a tooth ring;

a pawl base assembly for inserting into the ratchet wheel, having a front end, a rear end, and a plurality of pawl pieces for engaging with teeth on the tooth ring, the rear end of the pawl base assembly connecting to a handle of a screwdriver while the front end connecting to a head of the screwdriver; and a rings assembly adjustably mounted on the ratchet wheel, the rings assembly includes a ring and a release ring with an inner surface and an outer surface, the release ring is disposed inside the ring, the ring drives the release ring to rotate, the ratchet wheel is located within the ring, four push portions are provided on the inner surface of the release ring;

wherein the pawl base assembly includes a center rod with a front end, a middle section, and a rear part and a pedestal with a center hole and a rear end, the rear part of the center rod passes through the center hole of the pedestal, the middle section has a circular periphery, the pedestal has a circular periphery, the circular periphery of the middle section of the center rod is provided with a plurality of protrusions, and the inner surface at a front end of the ratchet wheel is provided with a plurality of limiting recesses for receiving the plurality of protrusions, the rear end of the pedestal connects to the handle of the screwdriver, and the head of the screwdriver inserts into the front end of the center rod, a first groove, a second groove, a third groove and a fourth groove are provided on the circular periphery of the pedestal, and a first pawl piece, a second pawl piece, a third pawl piece and a fourth pawl piece are respectively rotatably inserted into each of the four grooves, each pawl piece has a tooth-shape outer end for engaging with the teeth of the tooth ring, two elastic elements are respectively resisted between the first pawl piece and the fourth pawl piece, and between the second pawl piece and the third pawl piece, for pushing the first pawl piece away from the fourth pawl piece, and pushing the second pawl piece away from the third pawl piece, and the rings assembly is provided therein with a plurality of push portions for engaging the pawl pieces and selectively spacing the pawl pieces from the teeth of the tooth ring to rotate the pawl base assembly, and recesses for receiving the push portions are provided on an outer surface of the pedestal at corresponding positions to the grooves.

2. The ratchet screwdriver of claim 1, wherein the rear part of the center rod is provided with a first positioning slot, the center rod is clamped at the first positioning slot by a first clamping member to limit displacement of the pedestal.

3. The ratchet screwdriver of claim 1, wherein said plurality of protrusions comprises four protrusions distributed on the circular periphery of the center rod, correspondingly, and said plurality of limiting recesses comprises four limiting recesses on the front end of the ratchet wheel.

4. The ratchet screwdriver of claim 1, wherein the end of each of said groove is an arc groove with a C-shape, inner ends of the pawl pieces have arc surfaces, and the inner ends of the pawl pieces are rotatably disposed in the arc grooves.

5. The ratchet screwdriver of claim 1, wherein a side, in contact with the pawl pieces, of each push portion has a beveled edge with a gradient matched with a gradient of the side walls of the respective pawl pieces.

6. The ratchet screwdriver of claim 1, wherein the front part of the center rod is reduced to form an insertion portion, with a front circumference, on which a first spring is sheathed, the first spring pushing against a connecting portion, the front circumference of the insertion portion is provided with a second positioning slot in which a second clamping member is clamped to limit displacement of the connecting portion along the center rod, a first hole is provided behind and adjacent to the second positioning slot, a first steel ball, embedded in the center rod, protrudes from the first hole and presses against an inward-convex conical surface of a front segment of the connecting portion.

7. The ratchet screwdriver of claim 1, wherein the outer surface of the release ring is provided with a clamping bulge, and correspondingly, an inner surface of the ring is provided with a clamping slot.

8. The ratchet screwdriver of claim 1, wherein any two adjacent grooves among the four grooves are symmetrical relative to a center line of the pedestal, and any two spaced-apart grooves are symmetrical relative to a center axis of the pedestal.

9. The ratchet screwdriver of claim 1, wherein a bulge ring for engaging the ring is disposed adjacent to said pawl pieces on the pedestal, a side of the bulge ring is provided with a second blind hole with a second spring and a second steel ball placed on top of the second spring, the second spring pushes the second steel ball, the second steel ball, embedded in the pedestal, protrudes from the second blind hole and pushes against the inner surface of the release ring, a left positioning hole, a middle positioning hole and a right positioning hole matching the second steel ball are provided on the inner surface of the release ring, when the second steel ball is located in the middle positioning hole, the pawl pieces are just all meshed, and the pawl base assembly does not rotate, when the ring drives the release ring to rotate and the second steel ball is located in the left or right positioning hole, the pawl base assembly performs one-way rotation.

10. The ratchet screwdriver of claim 1, wherein the elastic elements are double-ring torsion springs.

11. The ratchet screwdriver of claim 6, wherein the connecting portion is a sleeve made of iron, an outer surface of the connecting portion has crisscrossing v-shaped grooves.

12. The ratchet screwdriver of claim 1, wherein the center rod is a hollow rod made of zinc alloy.

* * * * *